US005221230A

United States Patent [19]

Darvin et al.

[11] Patent Number: 5,221,230

[45] Date of Patent: Jun. 22, 1993

[54] PAINT SPRAYING BOOTH WITH SPLIT-FLOW VENTILATION

[76] Inventors: Charles H. Darvin, 4405 Valley Forge Rd., Durham, N.C. 27705; Jacqueline Ayer, 604 Brooklyn Ave., Apt. C, Oakland, Calif. 94606

[21] Appl. No.: 609,166

[22] Filed: Nov. 1, 1990

[51] Int. Cl.[5] ..... B05B 15/12

[52] U.S. Cl. ..... 454/53; 454/52

[58] Field of Search ..... 98/115.2; 118/326

[56] References Cited

U.S. PATENT DOCUMENTS

| | | | |
|---|---|---|---|
| 1,608,082 | 11/1926 | Curren | 98/115.2 |
| 4,313,369 | 2/1982 | Tsuruta et al. | 98/115.2 |
| 4,515,072 | 5/1985 | Crisp | 98/115.2 |

FOREIGN PATENT DOCUMENTS

| | | | |
|---|---|---|---|
| 2005184 | 4/1979 | United Kingdom | 98/115.2 |

*Primary Examiner*—Harold Joyce

*Attorney, Agent, or Firm*—Heller, Ehrman, White & McAuliffe

[57] ABSTRACT

A facility including a booth for solvent or paint application or drying process is provided with ventilation inlets and outlets to cause stratification of constituents such as VOCs or particulate in the booth. The ventilation air withdrawn from the booth is split into two air streams, one air stream contains a relatively low volatile organic compound (VOC) concentration, and the other a relatively high VOC concentration. The ventilation air from the low concentration stream is vented to the atmosphere (or alternatively back in the booth) and the ventilation air from the high concentration stream is conducted to a VOC emission control device. Thus, adequate VOC emission control is achieved, and the volume of air processed by the VOC emission control device is reduced, along with the corresponding VOC emission control costs.

9 Claims, 2 Drawing Sheets

PAINT SPRAYING BOOTH WITH SPLIT-FLOW VENTILATION

This invention was made with Government support under contract No. 68-02-4685.

TECHNICAL FIELD OF THE INVENTION

In general, the present invention relates to paint or solvent application booths or drying booths, and more particularly, this invention relates to such booths equipped with a split-flow ventilation system.

BACKGROUND OF THE INVENTION

A conventional paint or solvent application booth provides a fully or partially enclosed, climate controlled space in which workpiece(s) may be spray coated or otherwise treated. In typical paint spraying operations, the operator stands in the vicinity of the workpiece(s) and applies the coating with a paint atomizing system. Forced ventilation air is passed through the booth, picking up paint overspray particulate and solvent vapors. The minimum ventilation air flowrate is prescribed, by law or regulation, based on the type of paint application system used (i.e. air atomized, airless, or electrostatic spray application). Typically, a linear velocity of 100 feet per minute (fpm) is employed in spray booths. The ventilation air then passes through a particulate emission control system (PECS) prior to being exhausted to the outside atmosphere. The PECS is known in the art. In most cases, the PECS utilizes either a water curtain or dry filter system to remove the paint overspray particulate. The solvent vapor contained in the exhaust air is not removed by the PECS, and therefore is often exhausted without any control.

In many instances solvent emissions from paint or solvent spray operations must be controlled to an acceptable level, as required, for example, by law or regulation. However, for many booth operators, the costs of installing and operating an appropriate solvent, or volatile organic compound (VOC), emission control device are prohibitive. High control costs are due primarily to the high paint booth exhaust flowrates (10,000 cubic feet per minute (cfm) to 1,000,000 cfm, or higher) containing low solvent concentrations that typify painting operations. Furthermore, VOC emission control device must be large enough to process the entire booth exhaust air flow. The invention described herein provides a method for controlling paint booth VOC emissions.

U.S. Pat. No. 4,266,504 discloses a paint spraying booth assembly including a VOC emission control device in which part of the exhaust air is processed without differentiating its levels of solvent concentrations.

SUMMARY OF THE INVENTION

Accordingly, it is an objective of the present invention to provide an improved booth assembly for paint or solvent spraying, stripping, cleaning and/or baking operations and improved methods of VOC emission control for such operations.

It is yet another objective of the present invention to provide a booth assembly and method for improving the control of VOC emissions from the booth assembly.

The above and other objectives can be achieved in a crossflow booth having a nominally laminar air crossflow pattern. The laminar flow pattern preserves the natural stratification which occurs as a result of the paint application process. The stratification results in significant particulate and solvent vapor concentration variations throughout the booth. In general, crossflow booths have a ventilation zone containing a higher particulate and VOC concentration, and a ventilation zone having a significantly lower particulate and VOC concentration. The invention described here is an exhaust ventilation system which preserves this stratification, and uses it to reduce the flowrate to a VOC emission control device, thereby reducing the cost of VOC emission control. This ventilation system routes the exhaust air flow from the high VOC concentration zone to an emission control device, and routes the exhaust air flow from the low VOC concentration zone to the outside. Alternatively, at least a portion of the flow from the low concentration zone may be routed back into the booth. This split-flow ventilation system will significantly reduce the flowrate to the VOC emission control device, thereby significantly reducing the associated control costs while achieving adequate VOC emission control. The PECS on the booth is of a type that maintains the pollutant stratification pattern throughout the booth to the split-flow assembly.

DETAILED DESCRIPTION OF PREFERRED EMBODIMENTS

Figure 1:
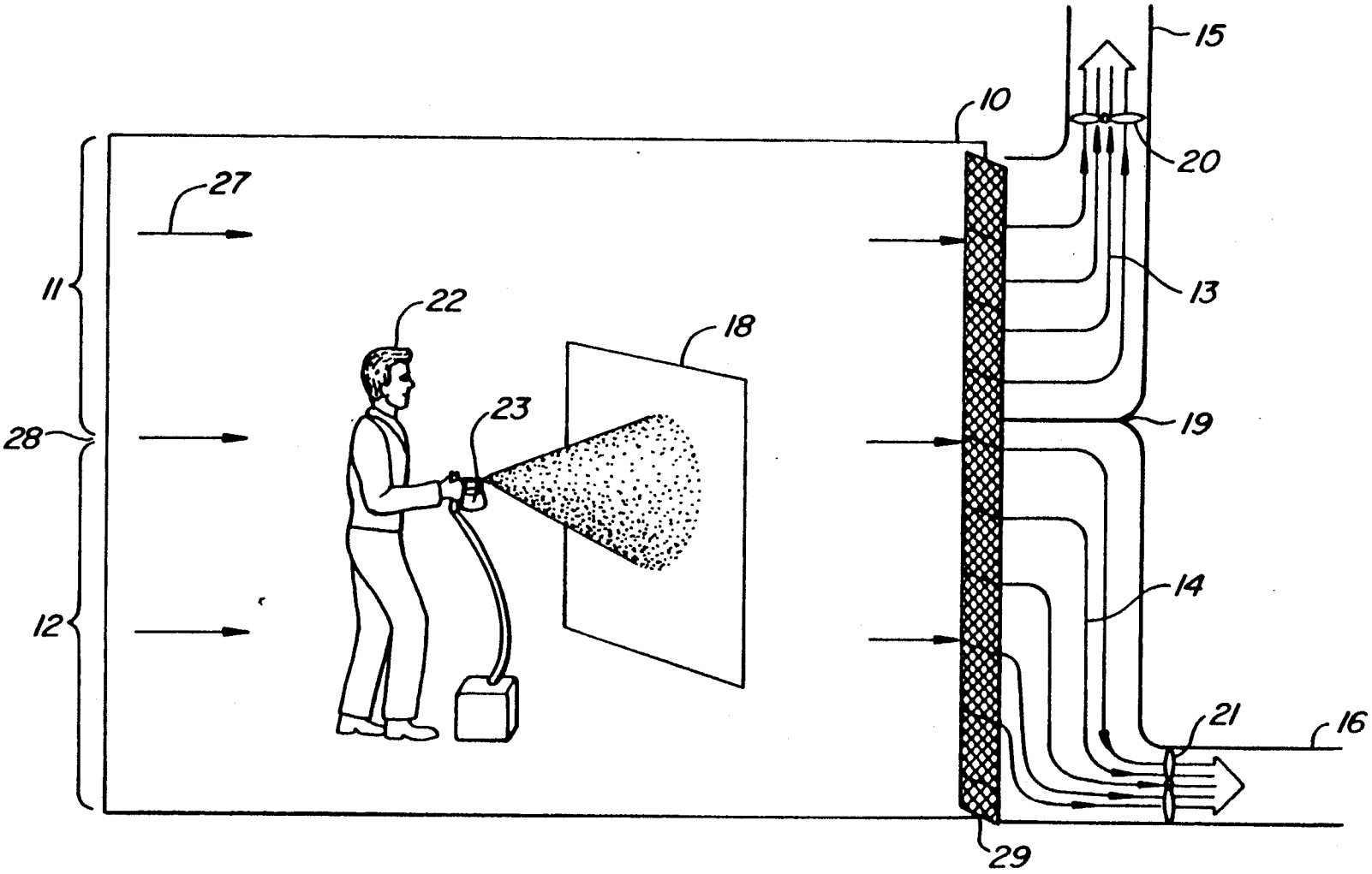
FIG. 1 illustrates an embodiment of the booth assembly according to the present invention. In this figure, particulate and solvent vapor stratification zones are indicated horizontally.

FIG. 1 illustrates one embodiment of the present invention. In the crossflow paint spray booth 10 illustrated, the operator 22 stands in the vicinity of the workpiece 18 and applies the coating with a paint atomizing system 23. The upper fan 20 and lower fan 21 withdraw ventilation air from the booth 10, and then drive it out of the smooth split duct 19 either through the upper exhaust duct 15 or lower exhaust duct 16. The ventilation air flow pattern in the booth 10 is indicated by air flow lines 27 to facilitate elaboration. Due to patterns and paint application methods, the concentration of pollutants of the ventilation air in the crossflow booth 10 is stratified into an upper zone 11 located above the stratification plane 28 and a lower zone 12 located below the stratification plane 28. As the ventilation air passes through the booth 10, it picks up paint overspray particulate and solvent vapor. The laminar flow pattern is maintained as the ventilation air passes the workpiece 18 (the presence of the workpiece 18 does not cause significant vertical flow pattern interruption) until it reaches the PECS 29, where the paint overspray particulate is removed. A dry filter PECS is preferred, such as, for example, a PECS comprising fiberglass fibers, which is known in the art. Immediately downstream of the PECS 29, the exhaust air flow indicated by the air flow lines 27 is split into two portions (air flow 13 and air flow 14) by the smooth split duct 19. The air flow 14 from the booth zone 12 containing higher VOC concentrations is drawn by the lower fan 21, and vented to a VOC emission control device (not shown) through the lower exhaust duct 16. The air flow 13 from the booth zone 11 containing lower solvent concentrations is drawn by the upper fan 20, and vented to the outside through the upper exhaust duct 15. Alternatively, the low concentration air flow 13 may be recirculated back into the booth 10 for improved VOC emission control.

The stratification of concentrations results in part from the fact that the workpiece 18 is much smaller than the booth 10. For example, booths operated by auto body shops are, in general, at least 7 feet high, however the autos painted rarely exceed 5 feet in height. In the laminar crossflow booth 10, the VOC and particulate tend to remain at the height at which painting occurs, however they may drop slightly due to the force of gravity. Solvents found in paint booths are typically heavier than air, such as toluene (MW 92.13), methyl ethyl ketone (MW 72.1) and xylene (MW 106.1). To accommodate air stratification pattern in the booth 10, the air flow 13 through the upper exhaust duct 15 and air flow 14 through lower exhaust duct 16 should be balanced. The stratification zones 11, 12 and sizes of the lower fan 21 and the upper fan 20 are determined by the position of the stratification plane 28 in the booth 10.

Even though the principle of the invention is described in terms of a paint spraying operation, the ventilation system illustrated in FIG. 1 can also be used in solvent spraying, paint removing and paint drying operations.

Figure 2:
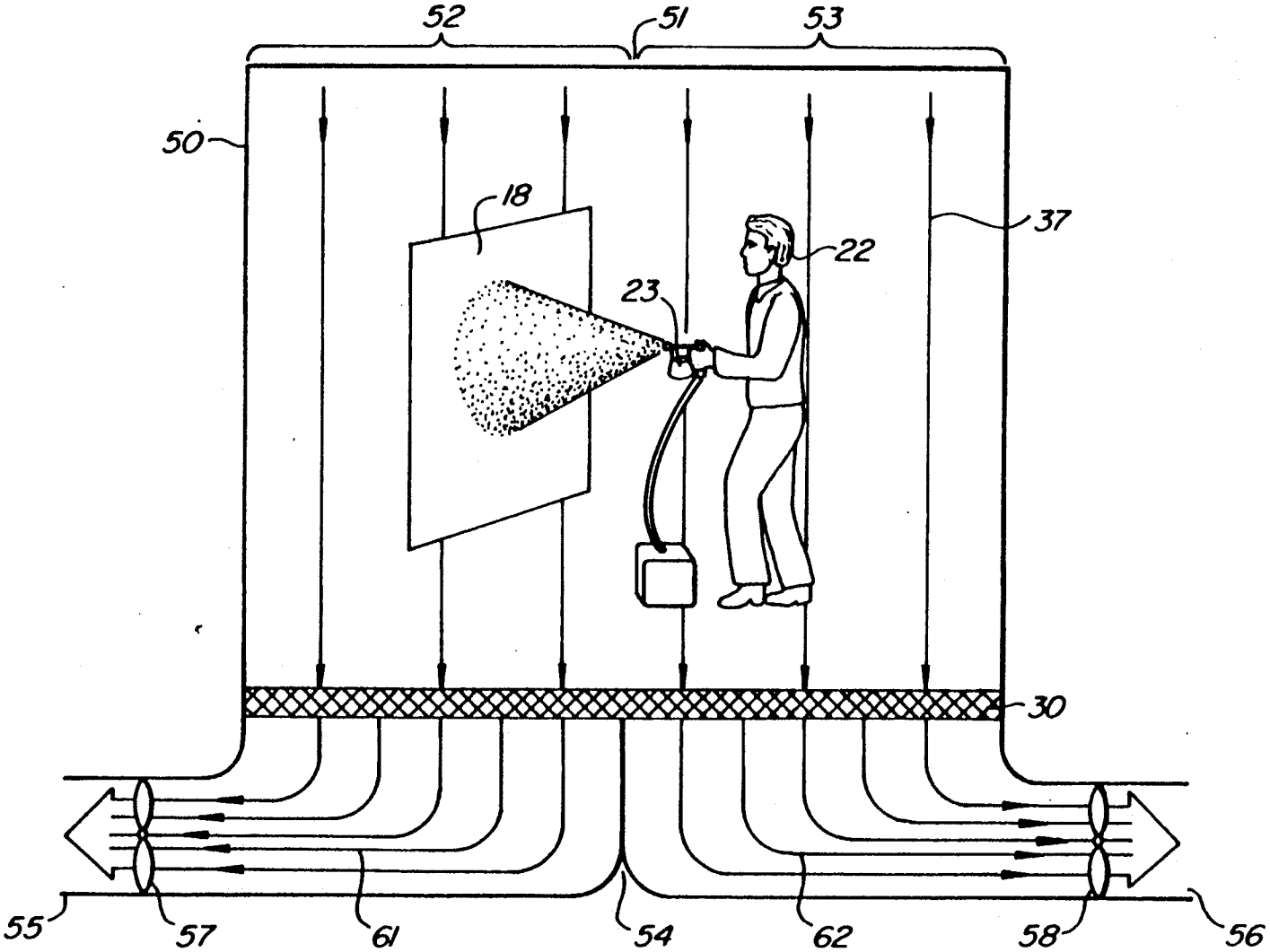
FIG. 2 illustrates another embodiment of the booth assembly according to the present invention. In this figure, particulate and solvent vapor stratification zones are indicated vertically.

In the embodiment shown in FIG. 1, the ventilation air flows horizontally through the booth 10. However, the principle of the invention also applies to a structure where the ventilation air flows vertically through the booth or working zone. In another embodiment of the present invention illustrated in FIG. 2, the ventilation air (indicated by air flow lines 37) exits the booth vertically through a PECS 30. A dry filter type of PECS is preferred, such as one comprising fiberglass fibers, which is known in the art. The working zone of the booth 52 is where higher VOC concentrations occur. The other booth zone 53 contains lower VOC concentrations. These zones 52, 53 are differentiated by the stratification plane 51. Above the PECS 30 is located a floor grate (not shown); and under the PECS 30 are located a smooth split duct 54, and two exhaust ducts 55, 56, each having a separate fan system 57, 58. The air 61 ventilating the working zone 52 has a higher VOC concentration, and passes through the floor grate (not shown) and the PECS 30, downstream of which it is separated by the smooth-split duct 54 from the ventilation air having a lower VOC concentration 62. The air 61 from the working zone 52 is drawn through an exhaust duct 55 by the fan system 57, and vented to a VOC emission control device (not shown). The air 62 ventilating the booth zone 53 having a lower VOC concentration passes through the floor grate (not shown) and the PECS 30, is separated by the smooth split-flow duct 54 from the ventilation air having a higher VOC concentration and is routed to the outside through an exhaust duct 56 by the fan system 58. The sizes of the fan system 57 and 58 are determined by the dimensions of the booth zones 52 and 53.

The principle of this invention applies to booths that are either fully enclosed or partially enclosed in which solvent process occur. This invention can also be combined with other flow reduction concepts such as recirculation. The advantage of this invention is that it reduces the size and operating cost of VOC emission control systems installed on booths in which paint or solvent spraying, removing and baking operations occur.

In summary, any modifications and variations of the disclosure given above that may be apparent to a person skilled in the art are intended to be included within the scope of this invention.

What is claimed is:

1. A facility for paint or solvent application, spraying or drying, comprising:

a working area that is enclosed or partially enclosed comprising a first region of high concentration of volatile organic compounds and a second region of low concentration of volatile organic compounds relative to said first region;

a means for driving air in a cross-flow through said working area whereby said air is driven through said working area in a laminar pattern comprising a first flowing zone of high concentration of volatile organic compounds and a second flowing zone of lower concentration of volatile organic compounds relative to said first flowing zone; and a smooth split-flow transition duct for splitting exhaust air from said facility containing volatile organic compounds into two zones comprising a first exhaust zone through which said first flowing zone is conducted containing a major portion of said volatile organic compounds, and a second exhaust zone through which said second flowing zone is conducted containing a minor portion of said volatile organic compounds.

2. The facility of claim 1, further comprising:

a first exhaust channel for withdrawing said exhaust air from said first zone; and a second exhaust channel for withdrawing said exhaust air from said second zone.

3. The facility of claim 2 wherein said first exhaust channel includes a first duct and a first fan assembly, and said second exhaust channel includes a second duct and a second fan assembly.

4. The facility of claim 1 wherein said working area comprises an enclosed or partially enclosed booth.

5. The facility of claim 4 wherein said driving means drives the air horizontally through said booth.

6. The facility of claim 4 wherein said driving means drives the air vertically through said booth.

7. The facility of claim 1 wherein said driving means comprises fan means.

8. A method for processing exhaust air contaminated with volatile organic compounds to reduce organic compound emissions from a working area, which is enclosed or partially enclosed comprising a first region of high concentration of volatile organic compounds and a second region of low concentration of volatile organic compounds relative to said first region comprising the steps of;

driving air in a cross-flow through said working area whereby said air is driven through said working area in a laminar flow pattern comprising a first flowing zone of high concentration of volatile organic compounds and a second flowing zone of low concentration of volatile organic compounds relative to said first flowing zone;

collecting and splitting the exhaust air in a transition duct into a first exhaust zone for collection of said first flowing zone containing a major portion of said volatile organic compounds and into a second exhaust zone for collection of said second flowing zone containing a minor portion of said volatile organic compounds;

withdrawing the air from said first exhaust zone through a first channel; and withdrawing the air from said second exhaust zone through a second channel.

9. A method of claim 8, further comprising the step of:

returning at least a portion of the air which passes through said second channel into said working area.

* * * * *